US011155994B2

(12) United States Patent
Manisier

(10) Patent No.: US 11,155,994 B2
(45) Date of Patent: Oct. 26, 2021

(54) MODULAR PREFABRICATED WALL SYSTEM AND A METHOD OF ASSEMBLY THEREOF

(71) Applicant: ACEFIELD CONSTRUCTIONS PTY LTD, Strathfield (AU)

(72) Inventor: Howard Manisier, Strathfield (AU)

(73) Assignee: ACEFIELD CONSTRUCTIONS PTY LTD, Strathfield (AU)

( * ) Notice: Subject to any disclaimer, the term of this patent is extended or adjusted under 35 U.S.C. 154(b) by 0 days.

(21) Appl. No.: 16/619,896

(22) PCT Filed: Jun. 22, 2018

(86) PCT No.: PCT/AU2018/050625
§ 371 (c)(1),
(2) Date: Dec. 5, 2019

(87) PCT Pub. No.: WO2019/018880
PCT Pub. Date: Jan. 31, 2019

(65) Prior Publication Data

US 2020/0157806 A1 May 21, 2020

(30) Foreign Application Priority Data

Jul. 22, 2017 (AU) ..... 2017902867

(51) Int. Cl.
*E04B 2/86* (2006.01)
*E04B 1/61* (2006.01)
*E04C 2/34* (2006.01)

(52) U.S. Cl.
CPC ..... *E04B 2/8635* (2013.01); *E04B 1/6116* (2013.01); *E04C 2/34* (2013.01); *E04B 2002/8676* (2013.01)

(58) Field of Classification Search
CPC ..... E04B 2/8635; E04B 1/6116; E04B 2002/8676; E04B 2/8629; E04B 2/44; E04B 1/4178; E04C 2/34; E04C 2/36
See application file for complete search history.

(56) References Cited

U.S. PATENT DOCUMENTS 2,860,388 A * 11/1958 Chapman ..... E06B 3/7015 428/120
4,104,837 A * 8/1978 Naito ..... B62D 27/06 52/239

(Continued)

OTHER PUBLICATIONS

International Search Report dated Sep. 7, 2018 from corresponding PCT Application No. PCT/AU2018/050625.

*Primary Examiner* — Patrick J Maestri
(74) *Attorney, Agent, or Firm* — Innovation Capital Law Group, LLP; Vic Lin

(57) ABSTRACT

There is provided herein a modular be fabricated wall system which has a number of interlocking modular prefabricated wall sections. Each wall section has opposing planar face boards and a number of orthogonal spacers adhered to respective inner faces of the face boards for bracing the face boards apart. Vertical joiners may be adhered to inner edges of each face board for quickly and easily vertically slotting together adjacent wall sections in a row. The present wall sections are low-cost in that both the face boards and the orthogonal spacers may be cut from low-cost board, such as fibre cement board. Specifically, the face boards and the spacers may be both made from fibre cement board and the spacers may be glued perpendicularly between inner surfaces of the face boards. As such, the present wall sections may be manufactured without fasteners, ties and the like.

18 Claims, 7 Drawing Sheets

(56) References Cited

U.S. PATENT DOCUMENTS

| | | | | |
|---|---|---|---|---|
| 4,433,522 | A | 2/1984 | Yerushalmi | |
| 5,465,545 | A | 11/1995 | Trousilek | |
| 6,070,380 | A | 6/2000 | Meilleur | |
| 6,167,671 | B1 | 1/2001 | Wilson | |
| 2005/0016103 | A1* | 1/2005 | Piccone | E04B 2/8641 52/481.1 |
| 2012/0047839 | A1* | 3/2012 | Walker | E04D 13/17 52/580 |

* cited by examiner

MODULAR PREFABRICATED WALL SYSTEM AND A METHOD OF ASSEMBLY THEREOF

FIELD OF THE INVENTION

This invention relates generally to a modular prefabricated wall system comprising a plurality of interlocking low-cost wall sections of simple and low-cost construction.

BACKGROUND OF THE INVENTION

Existing modular prefabricated wall systems may comprise a plurality of wall sections of various configurations which join together and into which concrete is poured to form a wall sections. These wall sections are typically manufactured from plastic.

For example, US 2005/0016103 A1 (PICCONE) 27 Jan. 2005 [hereinafter referred to as D1] discloses a concrete formwork system that enables the construction of a formwork assembly in which a desired regular spacing of internal supporting members is readily maintained, and that enables the construction of a formwork assembly that is readily scalable, such that desired variations in the thickness or other dimensions of the concrete structure can be accommodated without requiring the production and use of a multiplicity of unique individual components.

U.S. Pat. No. 5,465,545 A (TROUSILEK) 14 Nov. 1995 [hereinafter referred to as D2] discloses a multi-component modular system for use in fabricating wall structures of the type which may be fortified with concrete or other similar materials. The system includes in one embodiment a plurality of identical prefabricated forms, each form comprising an elongated, generally rectangular plastic member having a cavity defined by a pair of side panels and a pair of end panels.

U.S. Pat. No. 6,070,380 A (MEILLEUR) 6 Jun. 2000 [hereinafter referred to as D3] discloses prefabricated concrete formwork module that may be assembled with others similar modules in the manner of a brick wall to form a mould into which concrete is poured. The formwork module has a reinforcing structure preferably made of parallel grids connected by transverse tie-rods.

U.S. Pat. No. 6,167,671 B1 (WILSON) 2 Jan. 2001 [hereinafter referred to as D4] discloses a prefabricated concrete wall form system which can be taken to a construction site, joined to other wall forms to form a wall, and filled with concrete. The wall form has an outer wall and an inner wall, each of which can be made from gypsum wall board, plywood sheathing, OSB sheathing, medium density overlay plywood, cement board, rigid foam board, exterior gypsum sheathing, steel siding, steel or aluminum sheet, or fiberglass panels. The outer and inner panels are braced by a series of horizontal, zigzag wires. Vertical wood strips having horizontal grooves corresponding to the wires are used to hold these wires in place.

The present invention seeks to provide a modular prefabricated wall system, which aims to overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein a modular be fabricated wall system comprising a plurality of interlocking modular prefabricated wall sections.

Each wall section comprises opposing planar face boards and a plurality of spacers adhered orthogonally between respective inner faces of the face boards for bracing the face boards apart. Furthermore, vertical joiners may be adhered to inner edges of each face board for quickly and easily vertically slotting together adjacent wall sections in a row.

The present wall sections are low-cost in that both the face boards and the spacers may be cut from low-cost board, such as fibre cement board.

Specifically, the face boards and the spacers may be both made from fibre cement board and the spacers may be glued perpendicularly between inner surfaces of the face boards.

Furthermore, edge strips, which may also be made from the same type of board, may locate underneath and, in embodiments, above the edges of the spacers, enhancing the adherence of the spacers between the face boards and providing structural integrity.

As such, the present wall sections may be manufactured without fasteners, ties and the like.

The present spacers may be cut from a continuous sheet for cost saving. Furthermore, the present spacers may comprise an upper saddle for the central and proper location of reinforcement caging between the face boards.

The joiners may comprise simple male/female extruded plastic joiners which are adhered to front and rear edges of the wall sections to allow the wall sections to slot vertically in place together and to form a mould into which concrete can be poured from above.

As such, the present wall system may be constructed from relatively few constituent components as a substantially illustrated in FIGS. 6-10.

In embodiments, the spacers may be arranged into columns of orthogonally orientated angled spacers. The angle of the spacers may direct the downward flow of concrete sideways, preventing air pockets whilst the orthogonal arrangement of the spacers provides structural integrity against diagonal forces acting on the wall sections. Furthermore, the angle of the spacers may guide service conduits between columns of spacers when the wall sections are lowered atop the service conduits.

Once constructed, the face boards being made from fibre cement are more suitable for rendering as compared to plastic sections of prior art arrangements.

It should be noted that in embodiments the wall sections 2 may be made from other types of boarding material as opposed to fibre cement.

The present configuration allows for a low-cost and relatively simple modular prefabricated wall system.

For example, the construction of a modular prefabricated wall system may comprise the manufacture of a plurality of wall sections comprising the spacers and joiners made from board, preferably fibre cement board, which are glued together without fasteners. Low-cost and simple plastic extrusion joiners may be similarly glued to edges of each wall section.

Thereafter, a floor tray may be provided comprising right angled bracket side rails and braces therebetween within which a plurality of wall sections slot-in vertically. The wall sections may slot over upright extending service conduits which may be guided between the angled spacers. A row of wall sections may be terminated with an end board or right-angled wall section.

Once formed, concrete may be poured via the upper open end of the wall sections which may be spread laterally by the angled spacers to reduce or avoid air pockets.

Once set, the wall sections are left in place and may be easily rendered.

Other aspects of the invention are also disclosed.

In accordance with one embodiment, there is provided a modular prefabricated wall system comprising: a modular prefabricated wall section comprising: opposing planar face boards; spaced apart columns of a plurality of planar spacers adhered orthogonally between respective inner faces of the face boards for bracing the face boards apart, the spacers being angled between horizontal and vertical; and vertical joiners adhered to inner surface vertical edges of each face board for joining with an adjacent wall section in use.

The spacers and the face boards may be manufactured from the same material.

The face boards may be manufactured from fibre cement.

The spacers may be angled with respect to the vertical.

The spacers may be angled with respect to the vertical by approximately 45°.

The spacers may comprise first and second columns of spacers.

The columns may be spaced apart thereby defining a passage therebetween.

Each spacer of the first column may be orthogonal to each spacer of the second column.

The spacers of each column may be orientated such that the lower edge of each spacer may be spaced further away than the upper edge of each spacer with respect to the passage therebetween.

Each spacer may define an upper edge and wherein the edge may be shaped to define a saddle.

Each spacer may comprise a width of approximately 200 mm and a height of approximately 100 mm.

The spacers may be adhered respective inner surfaces of each board.

The modular prefabricated wall system may further comprise at least one edge strip adjacent each distal edge of each spacer.

The at least one edge strip may comprise at least one of inferior and superior edge strips.

The joiners may be configured for slot-in engagement wherein the wall section may be lowered with respect to an adjacent wall section.

The joiners may comprise respective male and female extrusions.

There is also provided a method of construction of a modular prefabricated wall system as described herein, the method comprising: locating a floor tray on a floor slab; fastening a wall section to the floor tray; lowering an adjacent wall section with respect to the wall section such that respective joiners of the wall sections interlock; and pouring concrete via upper open ends of the wall sections.

Lowering the adjacent wall section may comprise lowering the adjacent wall section over a protruding service conduit.

The method may further comprise fastening an end board to the adjacent wall section.

The end board may comprise joiners for fastening to the joiners of the adjacent wall section

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
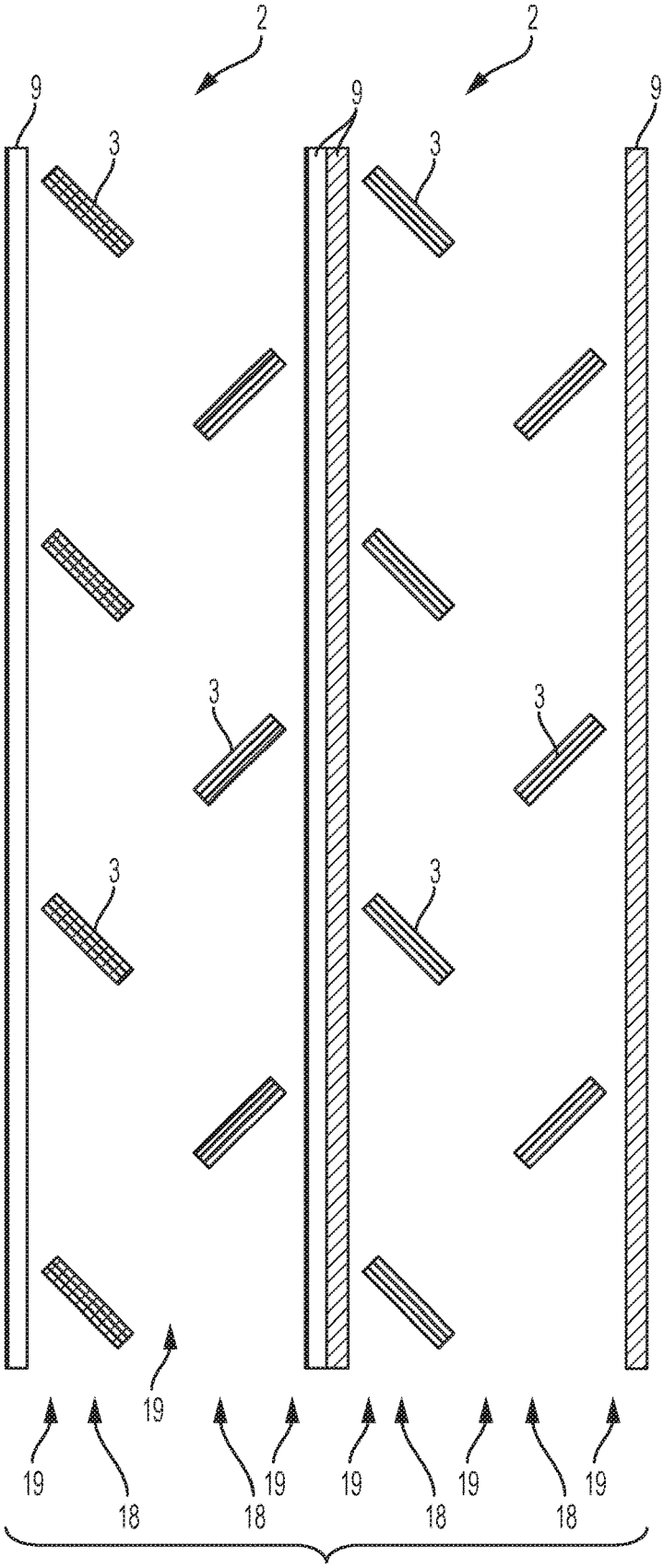
FIG. 1 shows a side cross-sectional elevation view of a modular prefabricated wall system comprising a pair of adjacently interlocking modular prefabricated wall sections in accordance with an embodiment.
Figure 2:
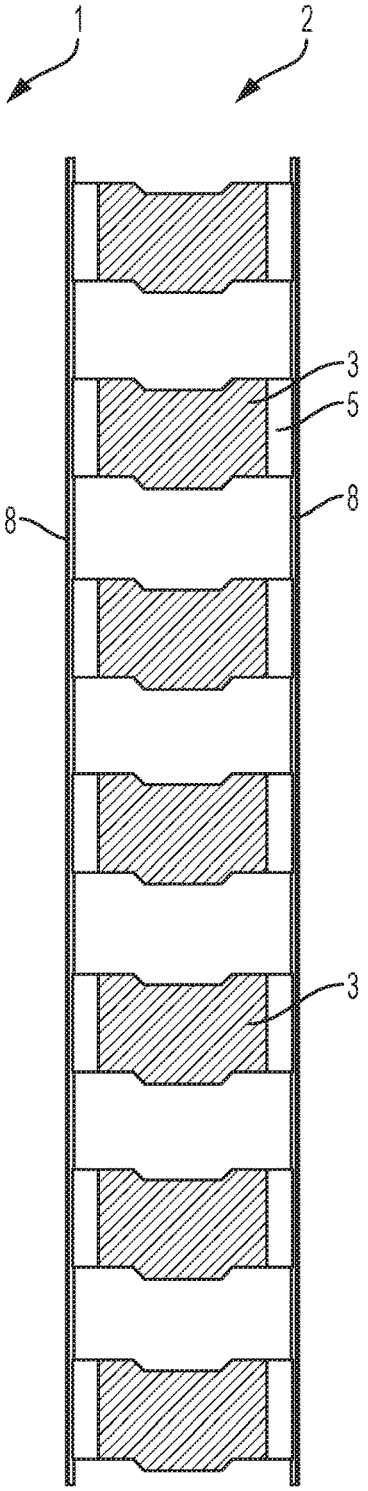
FIGS. 2 and 3 show front cross-sectional elevation views of the wall section.

FIG. 1 shows a cross-sectional side elevation view of the prefabricated wall system 1 comprising a plurality of adjacently interlocked wall sections 2. FIG. 2 further shows a front elevation view of the wall section 2.

Each wall section 2 comprises opposing planar face boards 8 which may be manufactured from fibre cement (Fibre Reinforced Cement) in one embodiment.

As can be seen especially from FIG. 2, so as to brace the face boards 8 apart and provide structural integrity for the wall system 1, a plurality of spacers 3 are adhered to respective inner faces of each face board 8. As such, the spacers 3 space the face boards 8 apart appropriately and provide structural integrity.

As can be further seen from FIG. 1, the spacers 3 may be arranged in columns 18 so as to define passages 19 therebetween which may be utilised for service conduits and the like. In the embodiment shown in FIG. 1, there is shown two columns 18 of spacers 3. However, in other embodiments, the wall sections 2 may be wider comprising a plurality of columns 18, such as three or more columns 18.

For the interlocking of adjacent wall sections 2 together, each wall section 2 may comprise vertical joiners 9 adhered to inner surface vertical edges of each face board 8 for joining with an adjacent wall section 2 in use.

Once a plurality of wall section 2 have been joined together utilising the joiners 9, cement may be poured via the upper open end of the wall sections 2 to form the resultant wall section.

As can be seen from FIG. 1, in a preferred embodiment, the spacers 3 are angled so as to facilitate flow and spreading of concrete poured therein. Specifically, the angle of each spacer 3 allows concrete flow from and across each spacer 3 as to facilitate the filling of the interior of the wall section 2 and prevent undesirous air gaps, especially underneath each spacer 3. Furthermore, the angle of each spacer 3 encourages the lateral spreading of poured concrete within the interior void.

Furthermore, the offsetting of the spacers 3 at an angle, including at orthogonal angles, increases the structural integrity of the wall system 1 and resists movement of the boards 8 with respect to each other, especially diagonally.

As can be seen from FIG. 1, the spacers 3 of each column may be oppositely angled, such as by being substantially orthogonal with respect to each other in one embodiment.

Figure 3:
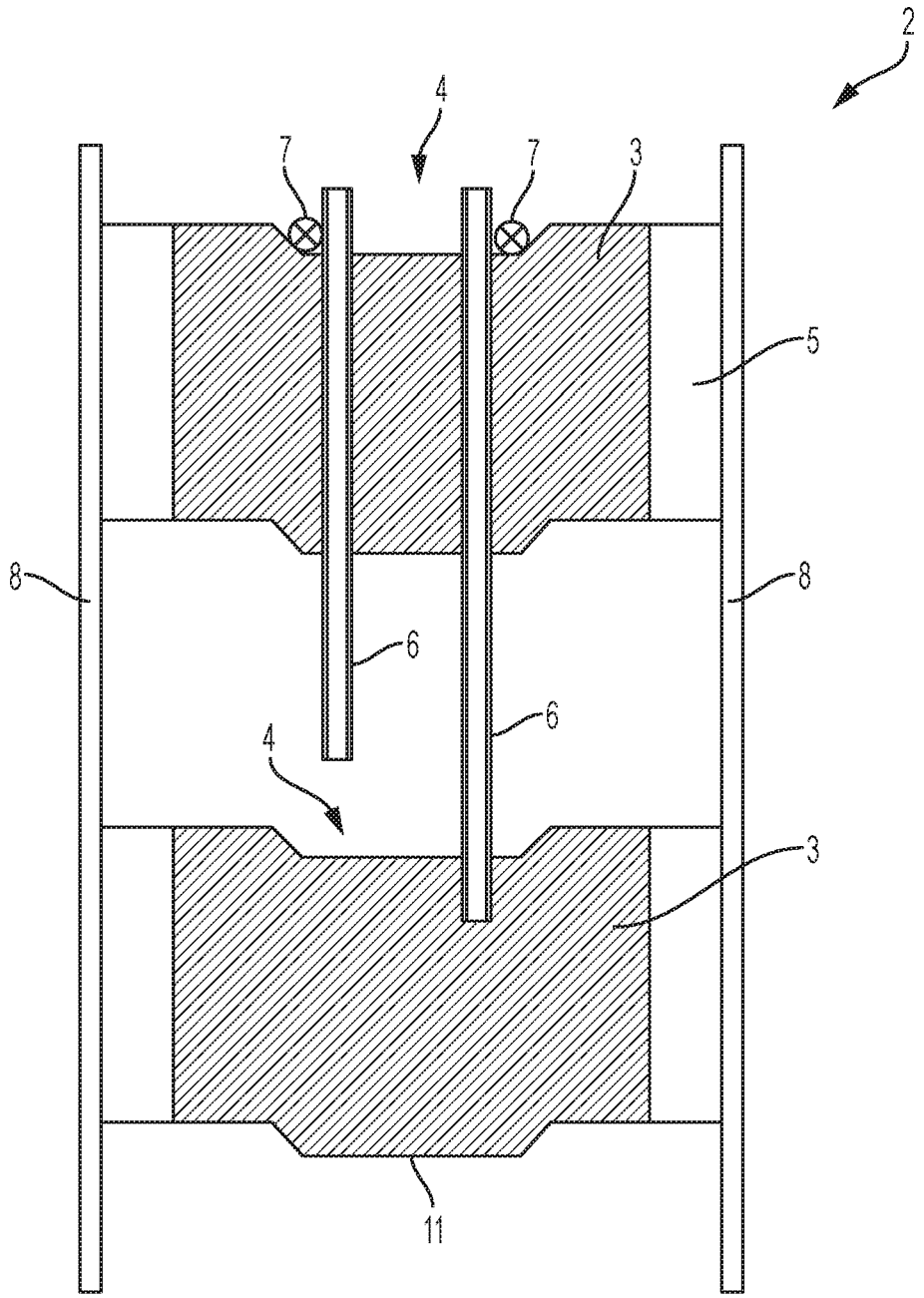

FIG. 3 shows a magnified front elevation view of the wall section 2 in accordance with an embodiment wherein each spacer 3 is cut so as to define a saddle 4 thereto. The saddle 4 may seat reinforcement caging above the spacers 3 and locate the reinforcement caging appropriately centrally between the face boards 8.

Specifically, the reinforcement caging may comprise vertical bars 6 and horizontal bars 7 and the saddle 4 may locate the horizontal bars 7 such that the bars 6, 7 are spaced apart from the inner faces of the adjacent boards 8 at the correct offset for reinforcement. For example, the saddle 4 may prevent the vertical bars 7 from locating too close to the inner surfaces of the boards 8.

In embodiments, the spacers 3 may be cut from a continuous sheet and therefore each spacer 3 may have an opposite tongue 11 corresponding to each saddle cutout 4.

Figure 4:
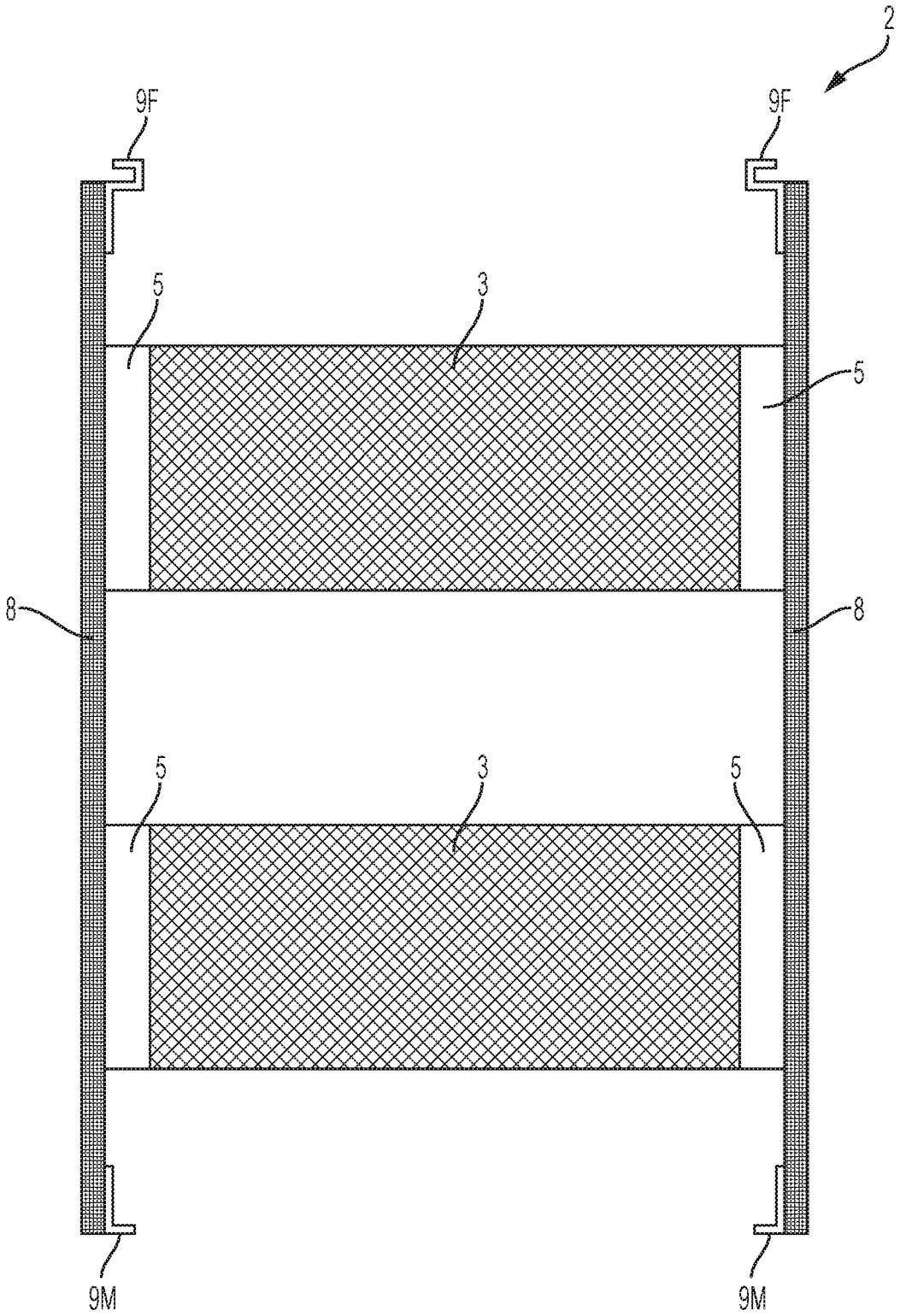
FIG. 4 shows a top plan view of the wall section.

FIG. 4 shows a bottom plan view of the wall section 2 showing the spacers 3 (without saddles 4). In this embodiment, as can be seen, the lateral edges of each spacer 3 may be supported by inferior support edge strips 5 which support each spacer 3 from underneath. In embodiments, an opposing extra edge strip 5 may additionally support the spacer 3 from above.

The utilisation of the support edge strips 5 allows the interface between the spacers 3 and the boards 8 more resilient to bending.

In embodiments, the spacers 3 are glued to the inner surfaces of each board 8. Similarly, the edge strips 5 may be glued to the spacers 3 and also to the inner faces of the boards 8. The utilisation of adhesive for joining the spacers 3 and the boards together 8 negates the need for fasteners and the like including those which may weaken the structural integrity of the boards 8.

Figure 8:
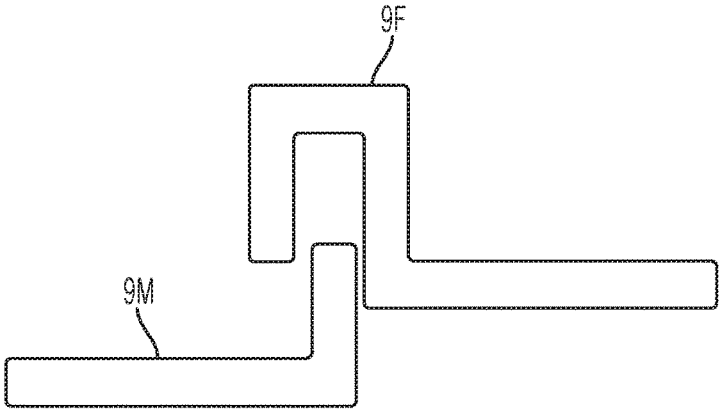

FIG. 8 further shows the joiners 9 in further detail. Specifically, as can be seen, the joiners 9 may comprise a female joiner 9F and a male joiner 9M which interlock together. In a preferred embodiment, the joiners 9 are configured for slot-in engagement as will be described in further detail below.

In embodiments, the joiners 9 take the form of strip extrusions which is similarly adhered to the inner surface vertical edges of each face board 8. In embodiments, the joiners 9 may be manufactured from plastic.

Figure 5:
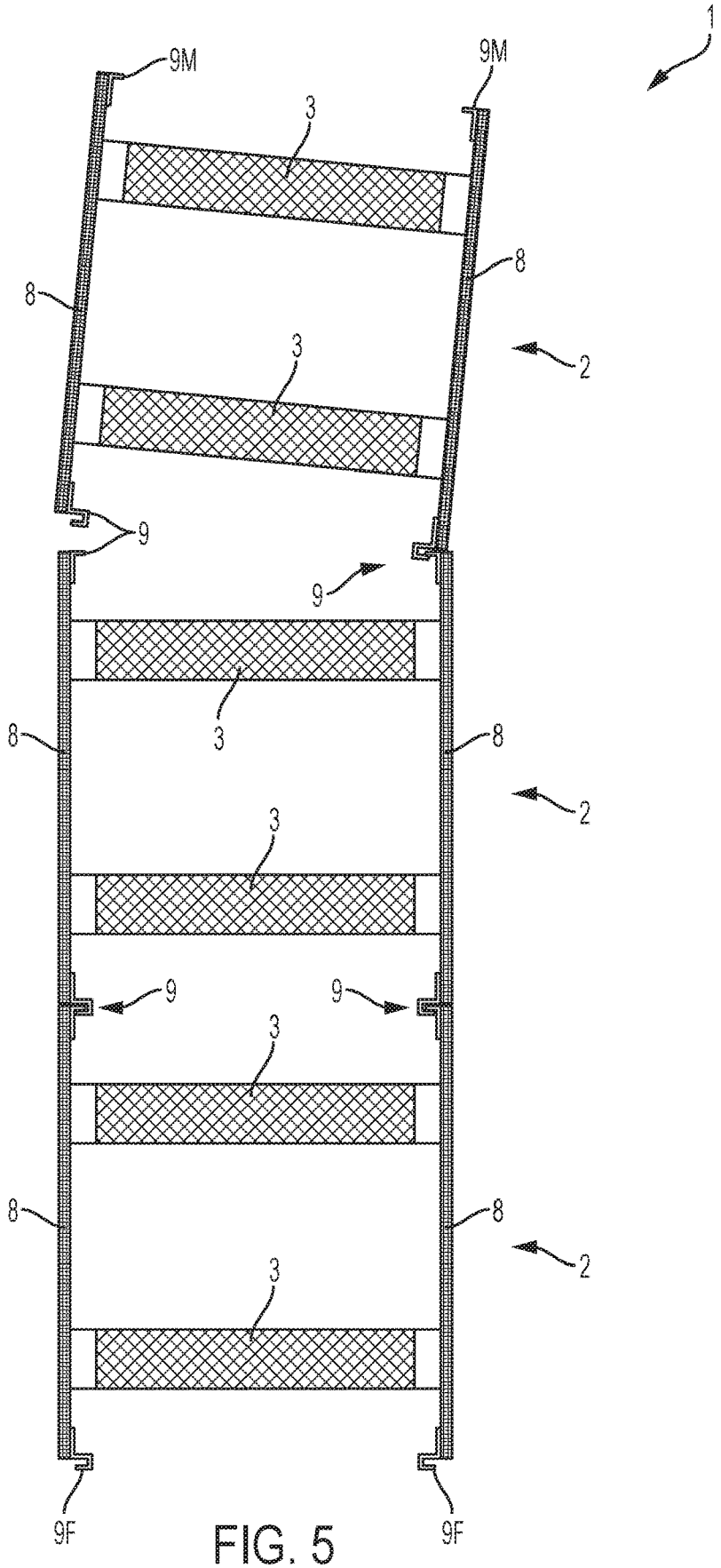
FIG. 5 shows a plurality of adjacent wall sections adjoined utilising joiners in accordance with an embodiment.

FIG. 5 a top view of the wall system 1 illustrating the utilisation of the joiners 9 for joining 3 the wall sections 2 together.

Figure 6:
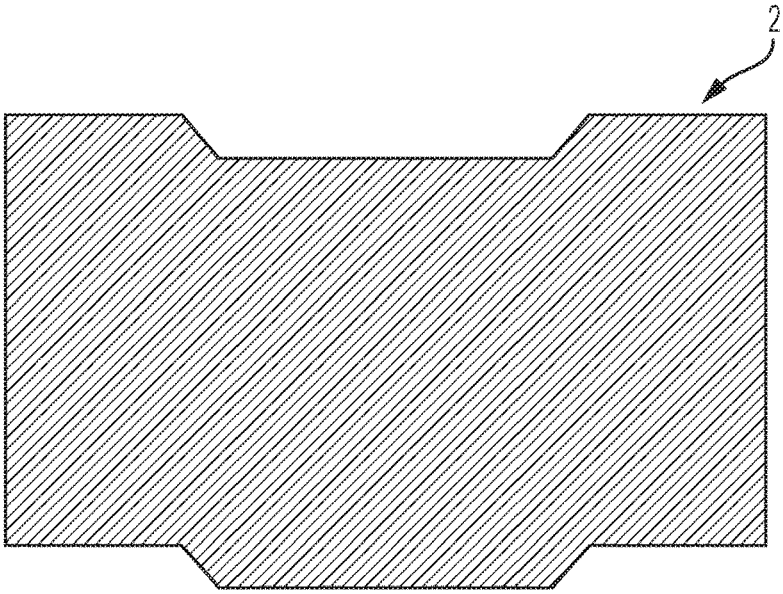
FIGS. 6-10 show the constituent componentry of the wall system in accordance with an embodiment.
Figure 7:
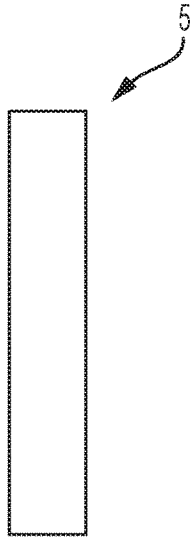

FIGS. 6-10 show the relatively little componentry required for the construction of the wall system 1. Specifically, FIG. 6 shows the spacer 3 which, in embodiments, may comprise a width of 200 mm, a height of 100 mm and a thickness of 6 mm. FIG. 7 shows the corresponding supportive edge strip 5 supporting the lateral edges of the spacer 3. In this regard, the edge strip 5 may comprise a height of approximately 100 mm, a thickness of approximately 6 mm and a width of approximately 10 mm.

FIG. 8 shows the interlocking of the corresponding male 9M and female 9F joiners.

Figure 9:
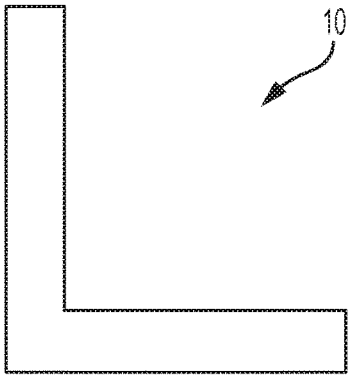

FIG. 9 shows a right-angled bracket 10 which may be utilised for the construction of the end caps and also the construction of the floor tray as will be described in further detail below.

Figure 10:
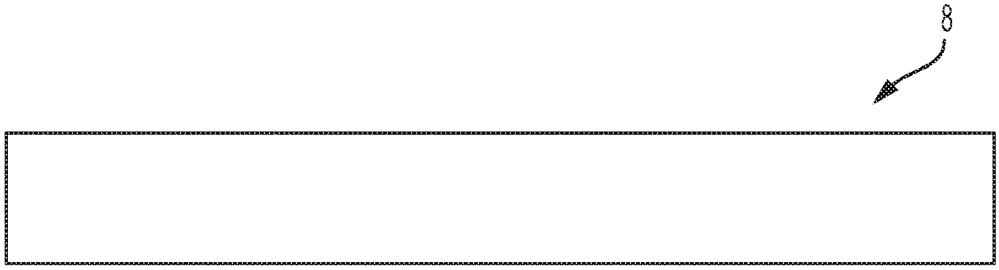

The FIG. 10 shows the face board 8 itself. In embodiments, the board 8 may comprise a length of approximately 3 m, a width of approximately 300 mm and a thickness of approximately 6 mm.

As such, the present modular prefabricated wall system 1 may be constructed utilising the constituent componentry shown in FIGS. 6-10.

Figure 11:
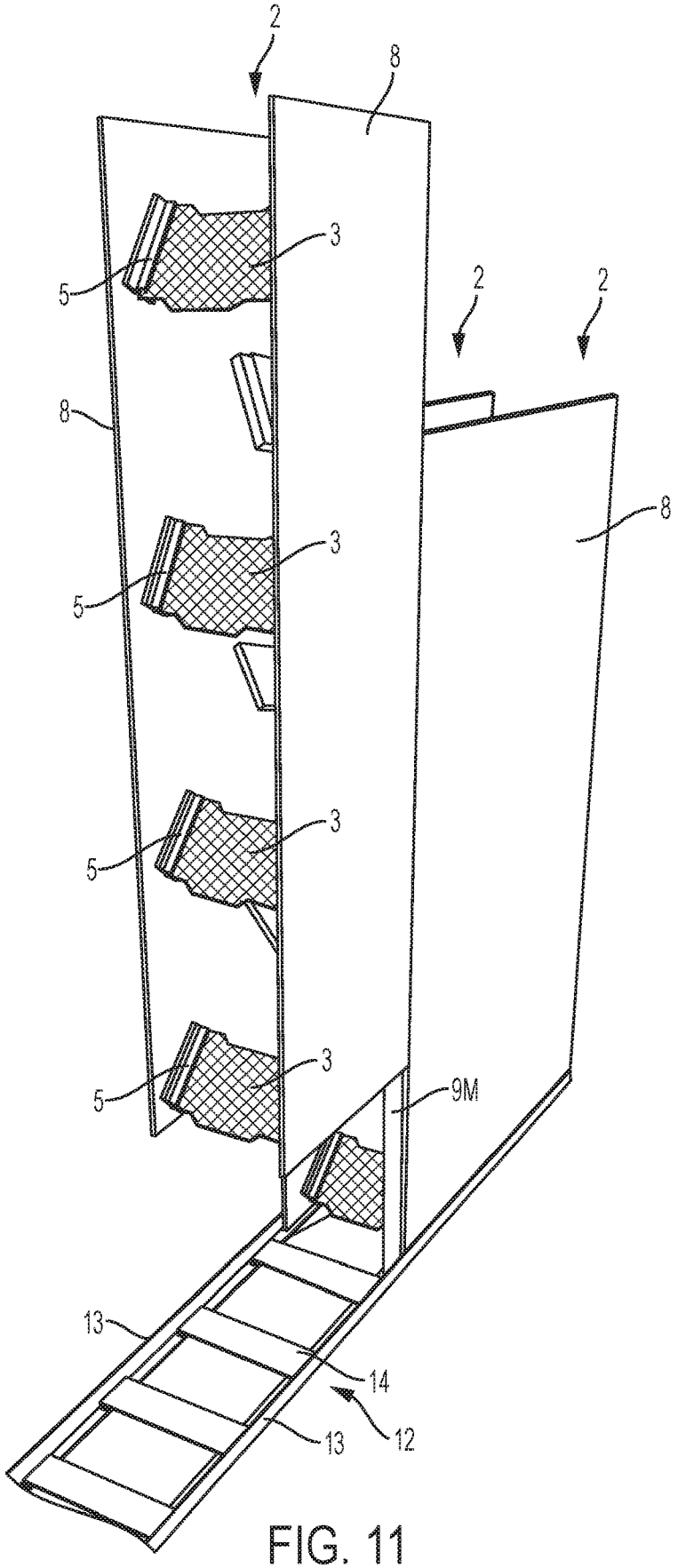
FIGS. 11-12 show the method of construction of the wall system in accordance with an embodiment.
Figure 12:
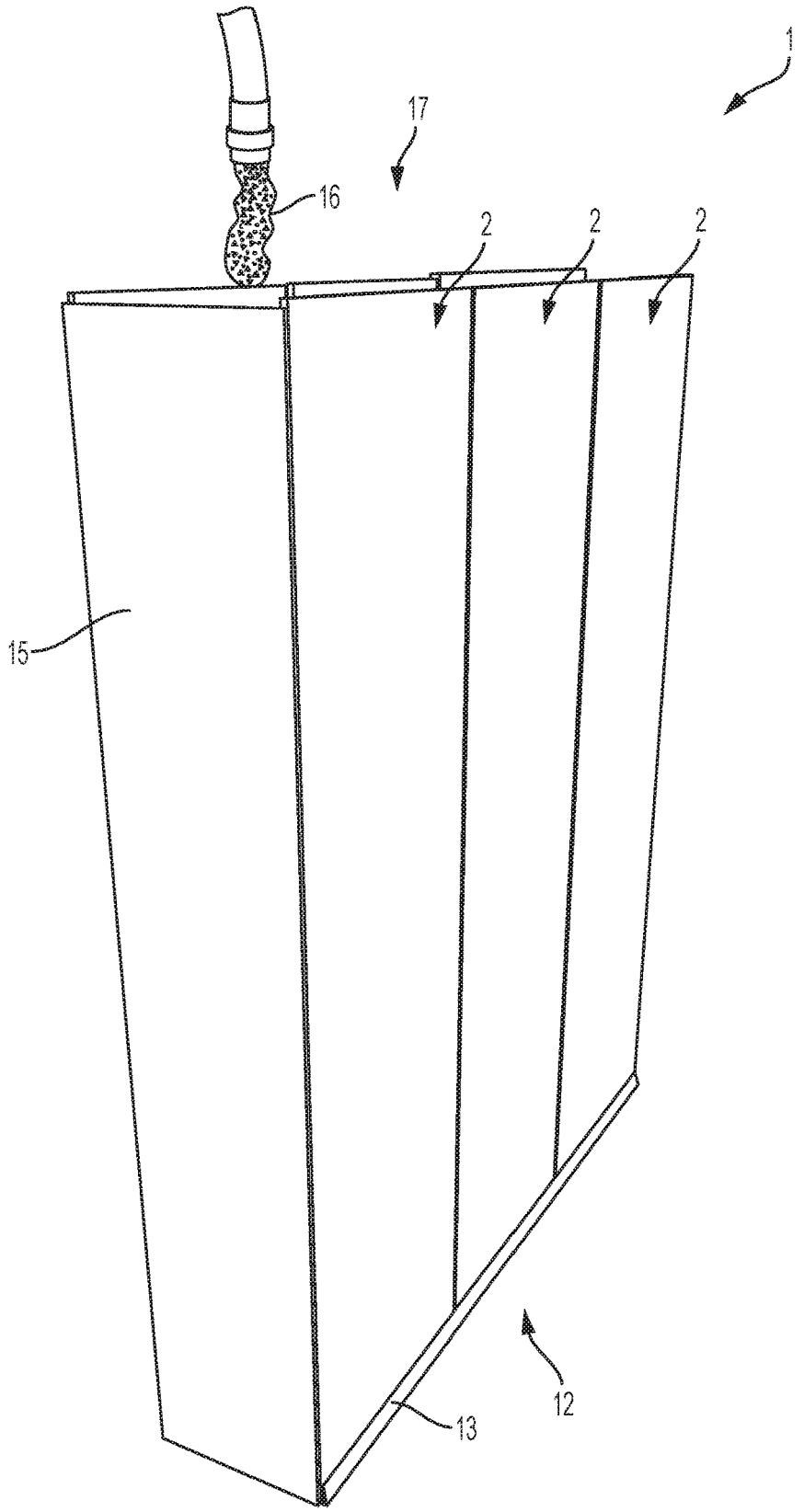

Turning now to FIGS. 11-13, there is provided exemplary methodology for the construction of the wall system 1.

FIG. 11 illustrates the provision of a floor tray 12 which may be affixed to the ground with fasteners. The floor tray 12 comprises right angled bracket lateral rails 13 comprising a plurality of braces 14 therebetween. The braces 14 may be made from wood, fibre cement or the like.

It should be noted that, in embodiments, each wall section 2 may be lowered over existing service conduits extended perpendicularly from a floor slab or the like. In such an embodiment, the spacers 3 of the adjacent columns 18 may be angled to face the conduit so as to guide the conduit therebetween. Specifically, the columns 18 of spacers 3 may be spaced apart so as to define a service conduit passage therebetween wherein the spacers 3 facing the passage face down towards the entrance of the service conduit such that, as the wall section 2 is lowered onto the service conduit, the facing faces of the spacers 3 guide the conduit up between the spacers 2.

FIG. 11 further illustrates a plurality of wall sections 2 located within the rails 13. Specifically, the rails 13 are spaced apart such that the upright edge flanges thereof locate around the exterior of the face boards 8. FIG. 11 illustrates two already-in-place wall sections 2 located within the rails 13 whilst an additional wall section 2 is lowered vertically to interlock with the adjacent already-in-place wall sections 2.

Each wall section 2 may be lowered from above such that the female joiners 9F of the wall section 2 being lowered slides vertically within the corresponding male joiners 9M of the adjacent wall section 2 already-in-place until such time that the wall section 2 being lowered locates between the rails 13. The vertical interlocking of the joiners 9 holds each wall section 2 together along the length of the rails 13, especially under hydrostatic pressure when being filled with concrete as described in further detail below.

FIG. 12 illustrates a completed wall system 1 comprising a plurality of interlocking wall sections 2 and closed at either end with an end board 15. Specifically, inner lateral surfaces of the end board 9 may similarly comprise the female joiners 9F which interlock with the male joiners 9M of the last wall section 2 such that the end board 9 may be lowered into place in a similar manner.

Once constructed, the reinforcement bar cage may be lowered in by the upper open end 17 of the wall structure 1 such that the horizontal bars 7 thereof locate within the saddles 4 of the spacers 3. Alternatively, the reinforcement bar cage may be located between the spacers 3 during manufacture and provided integrally with each wall section 2.

Additional service conduit may be run horizontally and/or vertically via the wall structure 1 as is required, including making access apertures, such as for plug points and the like within the face boards 8.

Thereafter, wet concrete 16 is poured via the upper open end 17 of the wall structure 1 and left to set. The wall sections 2, end board 15 and rails 13 are left in place.

In embodiments, the concrete 16 is poured in layers so as to reduce hydrostatic pressure on the wall structure 1.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A modular prefabricated wall system comprising:

a modular prefabricated wall section comprising:

opposing planar face boards;

spaced apart columns of a plurality of planar spacers adhered orthogonally between respective inner faces of the face boards for bracing the face boards apart, the spacers being angled between horizontal and vertical; and vertical joiners adhered to inner surface vertical edges of each face board for joining with an adjacent wall section in use, wherein a first angle between horizontal and vertical of one of the spaced apart columns is different from a second angle between horizontal and vertical of another one of the spaced apart columns; and wherein each spacer defines an upper edge and wherein the edge is shaped to define a saddle.

2. The modular prefabricated wall system as claimed in claim 1, wherein the spacers and the face boards are manufactured from the same material.

3. The modular prefabricated wall system as claimed in claim 1, wherein the face boards are manufactured from fibre cement.

4. The modular prefabricated wall system as claimed in claim 1, wherein the first angle with respect to the vertical is approximately 45°.

5. The modular prefabricated wall system as claimed in claim 1, wherein each spacer of each column is orthogonal to each spacer of each adjacent column.

6. The modular prefabricated wall system as claimed in claim 1, wherein the columns are two columns and wherein the spacers of each column are orientated such that respective lower edges of each spacer in each column is closer together than the respective upper edges thereof.

7. The modular prefabricated wall system as claimed in claim 1, wherein each spacer comprises a width of approximately 200 mm and a height of approximately 100 mm.

8. The modular prefabricated wall system as claimed in claim 1, wherein the spacers are adhered to respective inner surfaces of each board.

9. The modular prefabricated wall system as claimed in claim 8, further comprising at least one edge strip adjacent each distal edge of each spacer.

10. The modular prefabricated wall system as claimed in claim 9, wherein the at least one edge strip comprises at least one of an inferior edge strip positioned below each of the plurality of planar spacers and an extra edge strips positioned above each of the plurality of planar spacers.

11. The modular prefabricated wall system as claimed in claim 1, wherein the joiners are configured for slot-in engagement wherein the wall section is lowered with respect to an adjacent wall section.

12. The modular prefabricated wall system as claimed in claim 11, wherein the joiners comprise respective male and female extrusions.

13. A method of construction of the modular prefabricated wall system as claimed in claim 1, the method comprising:

locating a floor tray on a floor slab;

fastening the wall section to the floor tray;

lowering an adjacent wall section with respect to the wall section such that respective joiners of the wall sections interlock; and pouring concrete via upper open ends of the wall sections.

14. The method of construction of a modular prefabricated wall system as claimed in claim 13, wherein lowering the adjacent wall section comprises lowering the adjacent wall section over a protruding service conduit.

15. The method of construction of a modular prefabricated wall system as claimed in claim 14, further comprising fastening an end board to the adjacent wall section.

16. The method of construction of a modular prefabricated wall system as claimed in claim 15, wherein the end board comprises joiners for fastening to the joiners of the adjacent wall section.

17. A modular prefabricated wall system comprising:

a modular prefabricated wall section comprising:

opposing planar face boards;

spaced apart columns of a plurality of planar spacers adhered orthogonally between respective inner faces of the face boards for bracing the face boards apart, the spacers being angled between horizontal and vertical;

vertical joiners adhered to inner surface vertical edges of each face board for joining with an adjacent wall section in use; and at least one edge strip adjacent each distal edge of each spacer, wherein a first angle between horizontal and vertical of one of the spaced apart columns is different from a second angle between horizontal and vertical of another one of the spaced apart columns;

wherein the spacers are adhered to respective inner surfaces of each board; and wherein the at least one edge strip comprises at least one of an inferior edge strip positioned below each of the plurality of planar spacers and an extra edge strips positioned above each of the plurality of planar spacers.

18. A method of construction of the modular prefabricated wall system as claimed in claim 17, the method comprising:

locating a floor tray on a floor slab;

fastening the wall section to the floor tray;

lowering an adjacent wall section with respect to the wall section such that respective joiners of the wall sections interlock; and pouring concrete via upper open ends of the wall sections.

* * * * *